US012677929B2

(12) United States Patent
Tabata

(10) Patent No.: US 12,677,929 B2
(45) Date of Patent: Jul. 14, 2026

(54) BELT WITH BAG

(71) Applicant: Yoshimi Tabata, Saitama (JP)

(72) Inventor: Yoshimi Tabata, Saitama (JP)

( * ) Notice: Subject to any disclaimer, the term of this patent is extended or adjusted under 35 U.S.C. 154(b) by 26 days.

(21) Appl. No.: 18/680,731

(22) Filed: May 31, 2024

(65) Prior Publication Data

US 2024/0398099 A1 Dec. 5, 2024

(30) Foreign Application Priority Data

Jun. 1, 2023 (JP) ..... 2023-091207

(51) Int. Cl.
*A45F 3/00* (2006.01)
*A45F 3/14* (2006.01)

(52) U.S. Cl.
CPC ..... *A45F 3/005* (2013.01); *A45F 2003/144* (2013.01)

(58) Field of Classification Search
CPC .... A41F 9/00; A41F 9/002; A41F 9/02; A41F 9/025; A45F 3/005; A45F 3/14; A45F 2003/144
See application file for complete search history.

(56) References Cited

U.S. PATENT DOCUMENTS 2,351,158 A * 6/1944 Stelzer ..... A41F 9/002 150/132
4,029,243 A * 6/1977 Zerobnick ..... A45F 3/00 224/664
4,523,703 A * 6/1985 McKenna ..... A45F 3/00 224/660
5,003,634 A * 4/1991 Brinkman ..... A41D 13/0537 2/92
5,241,706 A * 9/1993 Netz ..... A41D 15/00 2/46
5,341,928 A * 8/1994 Jones ..... A63B 55/408 224/919
5,452,476 A * 9/1995 Jenks ..... A41D 3/00 224/660
5,540,366 A * 7/1996 Coomber ..... A45F 3/00 224/664
5,558,440 A * 9/1996 Miller ..... A45F 5/00 224/663
5,862,526 A * 1/1999 Longcor ..... A45C 11/18 2/253
6,016,772 A * 1/2000 Noyes ..... A01K 27/006 224/664
6,189,154 B1 * 2/2001 Ducharme ..... A45F 3/00 224/664

(Continued)

FOREIGN PATENT DOCUMENTS

JP S5720210 A 2/1982
JP 2010-517724 A 5/2010

(Continued)

*Primary Examiner* — F Griffin Hall
(74) *Attorney, Agent, or Firm* — Fitch, Even, Tabin & Flannery LLP

(57) ABSTRACT

A belt according to one embodiment includes: a bag at least partly formed of a stretchable fabric; and a belt body extending from the bag. On a side of the bag with a fastener that opens and closes an access opening of the bag, the bag has at least one folded portion at which the fabric of the bag is folded on an outer side of the fastener.

4 Claims, 14 Drawing Sheets

(56) References Cited

U.S. PATENT DOCUMENTS

| | | | | |
|---|---|---|---|---|
| 6,311,336 | B1 * | 11/2001 | Gootrad | A45C 11/22 224/257 |
| 10,010,158 | B2 * | 7/2018 | Do | A41D 27/205 |
| 10,477,905 | B1 * | 11/2019 | Sachs | A45F 4/12 |
| 10,973,270 | B2 * | 4/2021 | Marshall | A41F 9/025 |
| 10,986,886 | B2 * | 4/2021 | Willows | A45C 13/103 |
| 11,350,725 | B2 * | 6/2022 | Simon Niada Stanton Yonge | A45F 5/1541 |
| 2003/0189076 | A1 * | 10/2003 | Shapess | A45C 1/04 224/587 |
| 2008/0190980 | A1 * | 8/2008 | Overton | A45F 3/14 224/660 |
| 2009/0241235 | A1 * | 10/2009 | Weinreb | A45F 4/12 2/87 |
| 2014/0373246 | A1 * | 12/2014 | Chapuis | A41D 15/04 2/69 |
| 2021/0235799 | A1 * | 8/2021 | Willows | A41D 27/20 |

FOREIGN PATENT DOCUMENTS

| | | | |
|---|---|---|---|
| JP | 4929499 | B2 | 5/2012 |
| JP | 4953399 | B2 | 6/2012 |
| KR | 20100013007 | U | 12/2010 |

* cited by examiner

BELT WITH BAG

CROSS-REFERENCE TO RELATED APPLICATION

This application claims priority to Japanese Patent Application No. 2023-091207, filed Jun. 1, 2023, the entire contents of which are incorporated herein by reference.

FIELD

The technology of the present disclosure relates to a belt with a bag and in particular to a belt that includes a bag and a belt body and is used by, for example, locking its opposite ends to each other and wearing it around the waist or the like or wearing it diagonally over one shoulder to one flank.

BACKGROUND

Various belts with a bag and a belt body have been proposed and actually used. For example, Japanese Patent No. 4953399 (Patent Literature 1) discloses a waist bag. This waist bag includes a waist bag body with a stretchable belt. This waist bag body is formed of a material which is a synthetic resin and has flexibility and stretchability. This waist bag body has an accommodation portion with an access opening, which is closed with an engagement fastener in an openable and closable fashion. This waist bag is used by engaging a buckle on the belt and wearing the bag around a person's waist.

Also, Japanese Patent No. 4929499 (Patent Literature 2) discloses a belt with a pouch. The pouch of this belt has features including: one or more elastic materials being folded on the back of the belt so as to enclose the inner volume; a fastener being provided at substantially the center of a front portion of the pouch parallel to the longitudinal axis so as to enclose the inner volume of the pouch; and the fastener limiting the elasticity of the pouch in a direction parallel to the longitudinal axis.

SUMMARY

Incidentally, since the waist bag body of the waist bag in Patent Literature 1 is formed of a stretchable material, the inner volume of the waist bag body can expand according to the article that is put into it. Also, since the pouch of the belt in Patent Literature 2 is configured to be folded on the back of the belt, the inner volume of the pouch can expand according to the article that is put into it. Here, such conventional pouches, which are made of an elastic material or the like and whose inner volumes change, may be worn on a person's body with an article with a certain weight or size or more accommodated therein. In this case, their shapes may become so large as to appear out of proportion for the engagement fastener or the fastener. It has been pointed out that this is likely to impair the sense of unity with the person's body, such as the fit or the wearability, and greatly move the pouch accommodating the article back and forth relative to the person's body as the body moves.

Thus, an object of the technology of the present disclosure is to provide a configuration of a belt including a bag and a belt body which is directed to holding the bag itself toward an engagement member at the access opening of the bag when an article is put in the bag.

One aspect of the technology of the present disclosure provides a belt including: a bag at least partly formed of a stretchable fabric; and a belt body extending from the bag.

On a side of the bag with an engagement member that opens and closes an access opening of the bag, the bag has at least one folded portion at which the fabric of the bag is folded on an outer side of the engagement member.

According to the technology of the present disclosure with the above configuration, on the side of the bag with the engagement member that opens and closes the access opening of the bag, the bag has at least one folded portion at which the stretchable fabric of the bag is folded on the outer side of the engagement member. In this way, when an article is put in the bag, an elastic force that holds the bag itself toward the engagement member at the access opening of the bag is applied to the fabric.

The folded portion preferably extends substantially parallel to the engagement member in the longitudinal direction of the bag and is provided on opposite lateral sides of the engagement member. In this configuration, the folded portion is provided on the opposite lateral sides of the engagement member. Thus, when an article is put in the bag, an elastic force that holds the bag itself toward the engagement member at the access opening of the bag is applied to the fabric. Accordingly, the article is retained more reliably.

At the ends of the bag in the longitudinal direction, the fabric of the bag preferably has the folded portion and is fixed to the engagement member in a compressed state in a thickness direction. With this configuration, the folded portion of the fabric makes it possible to more reliably maintain the shape. Thus, when an article is put in the bag, an elastic force that holds the bag itself toward the engagement member at the access opening of the bag is applied in a more preferable manner to the fabric.

Preferably, on a rear side of the bag behind the engagement member, the fabric extends smoothly from one side toward another side in a width direction. With this configuration, when an article is put in the bag, the bag is less likely to expand unnecessarily in a direction away from the engagement member of the bag.

In accordance with the technology of the present disclosure, a belt including a bag and a belt body can apply an elastic force in such a direction as to hold the bag itself toward an engagement member at an access opening of the bag to the fabric of the bag when an article is put in the bag.

DETAILED DESCRIPTION

Figure 1:
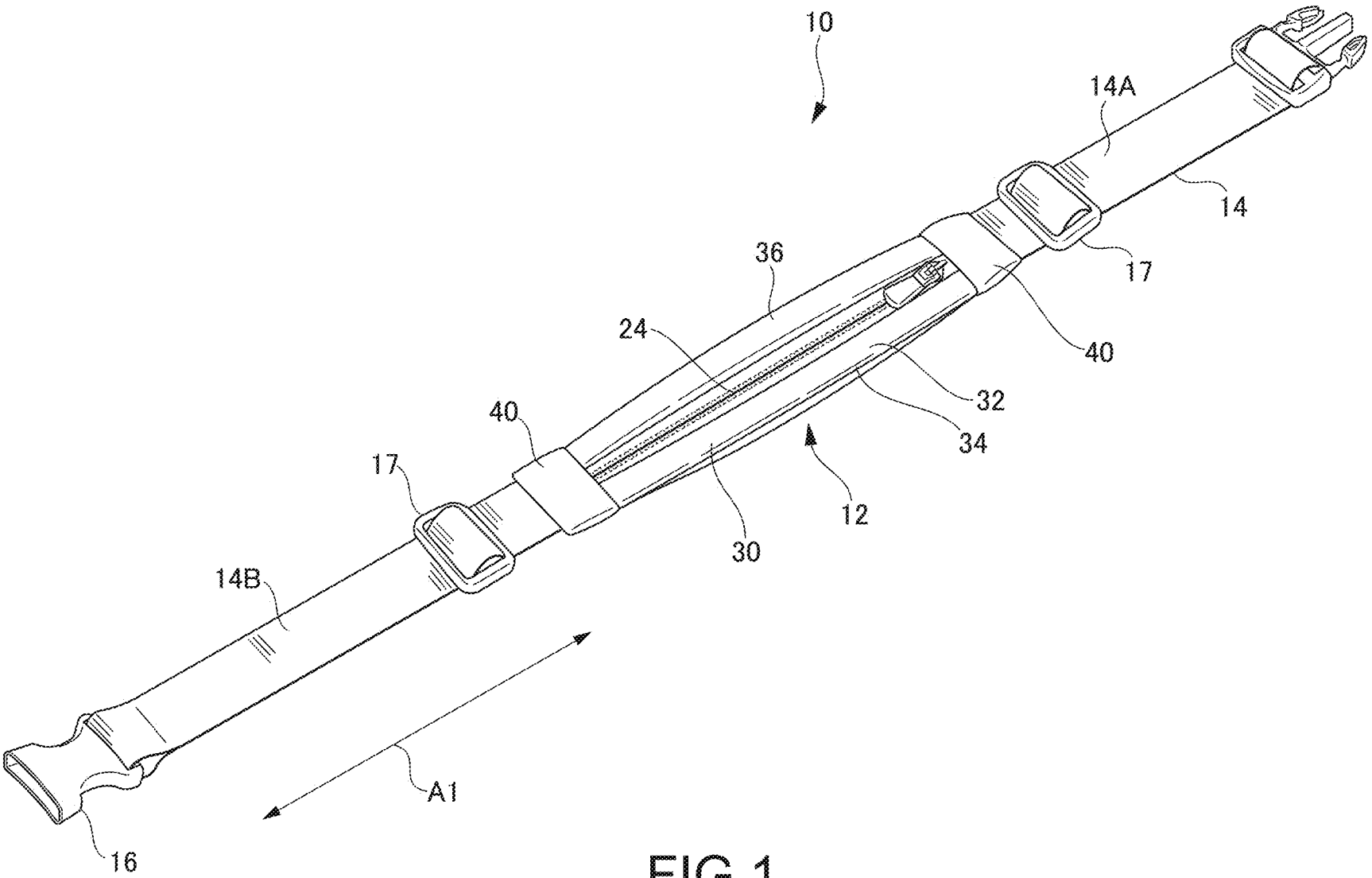
FIG. 1 is a perspective view of a belt according to a first embodiment with a buckle disengaged.
Figure 2:
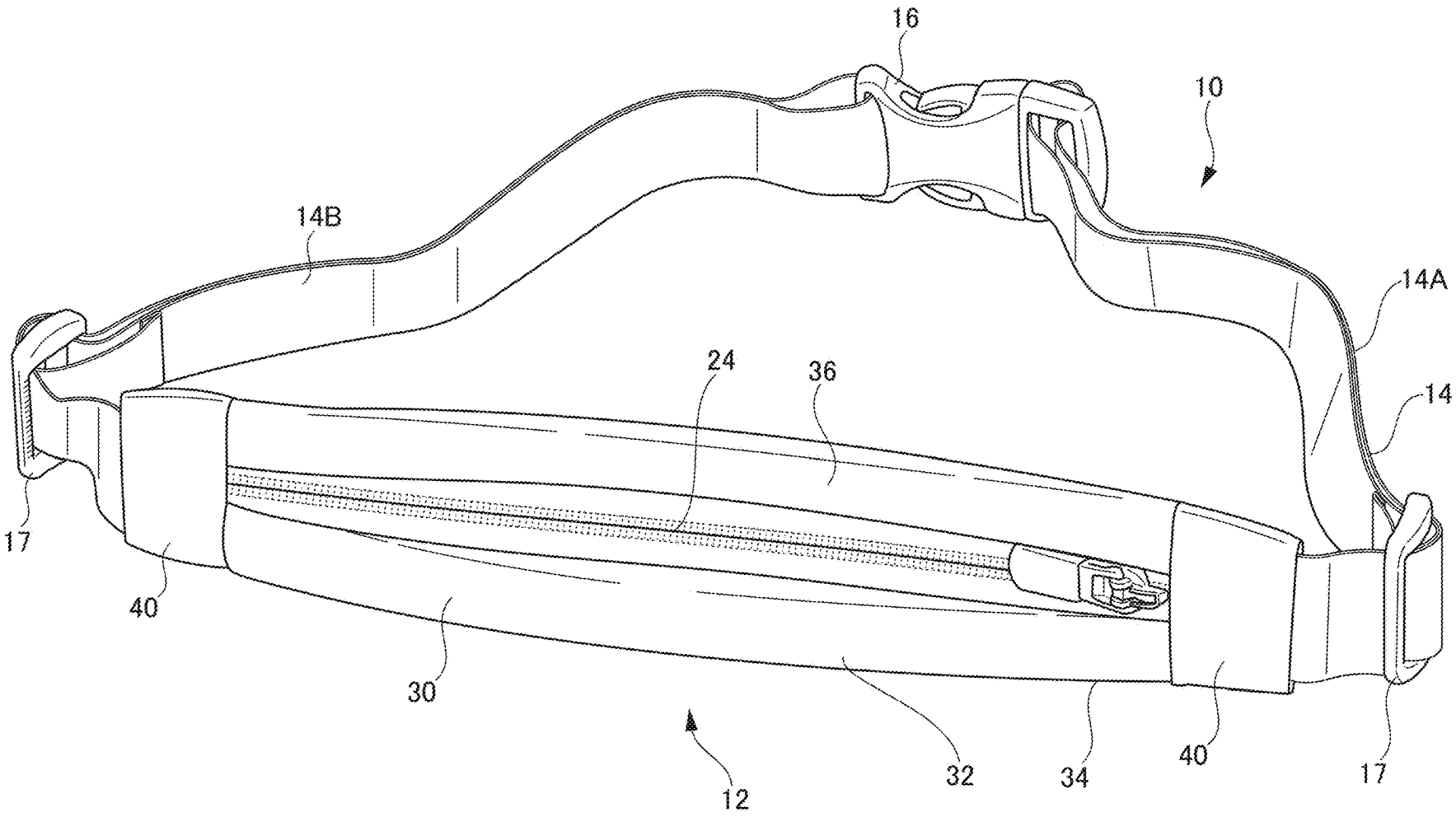
FIG. 2 is a perspective view of the belt illustrated in FIG. 1 with the buckle engaged.
Figure 3A:
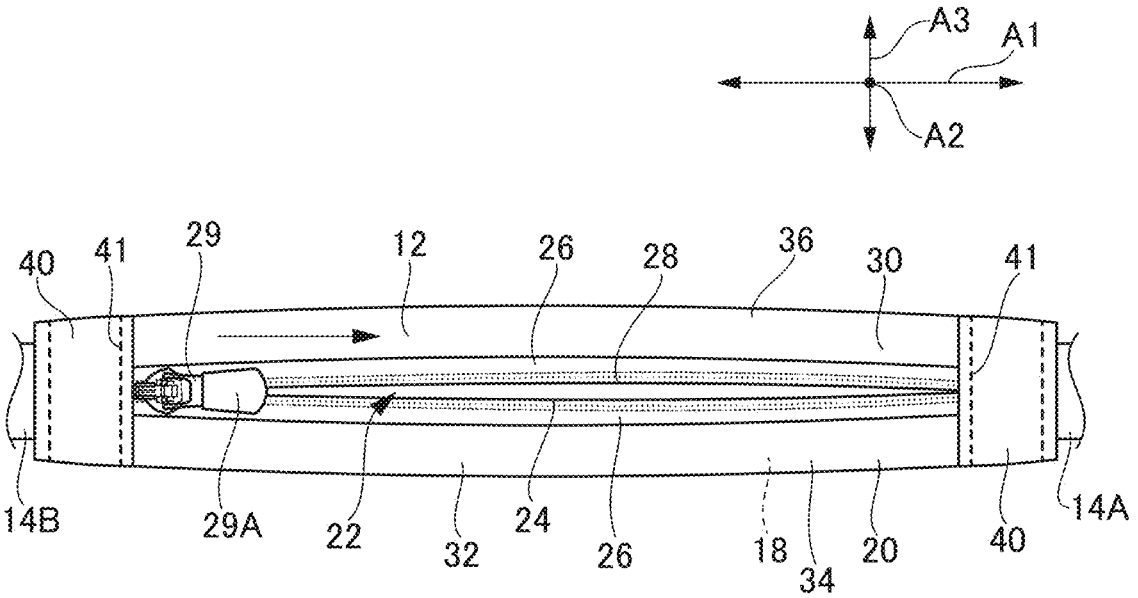
FIG. 3A is a plan view of a bag part of the belt illustrated in FIG. 1, illustrating a state where a fastener is open.
Figure 3B:
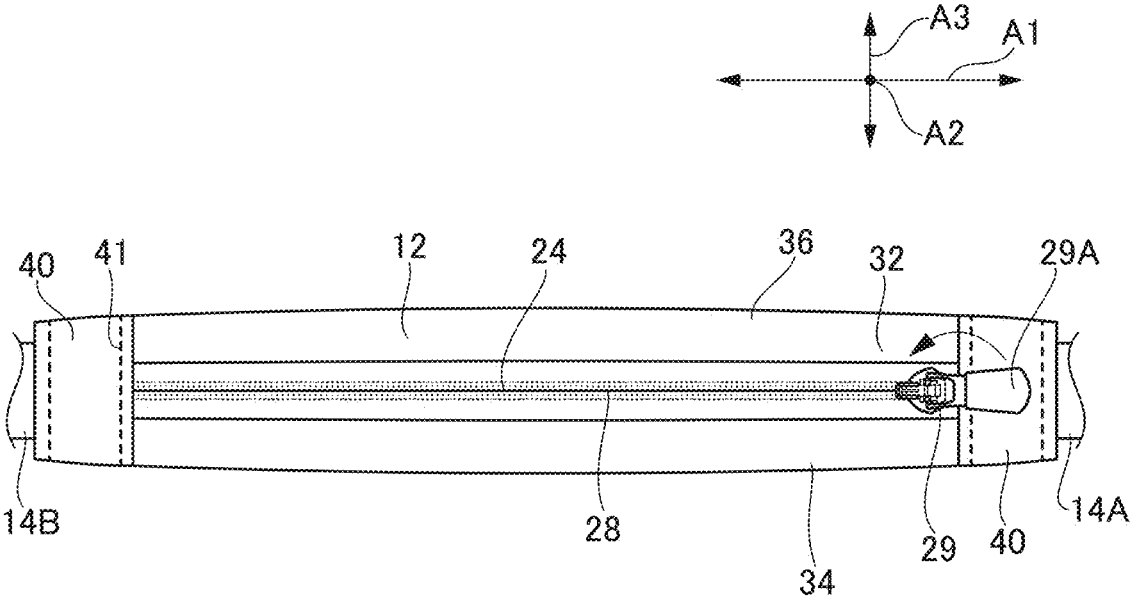
FIG. 3B is a plan view of the bag part of the belt illustrated in FIG. 1, illustrating a state where the fastener is closed.
Figure 3C:
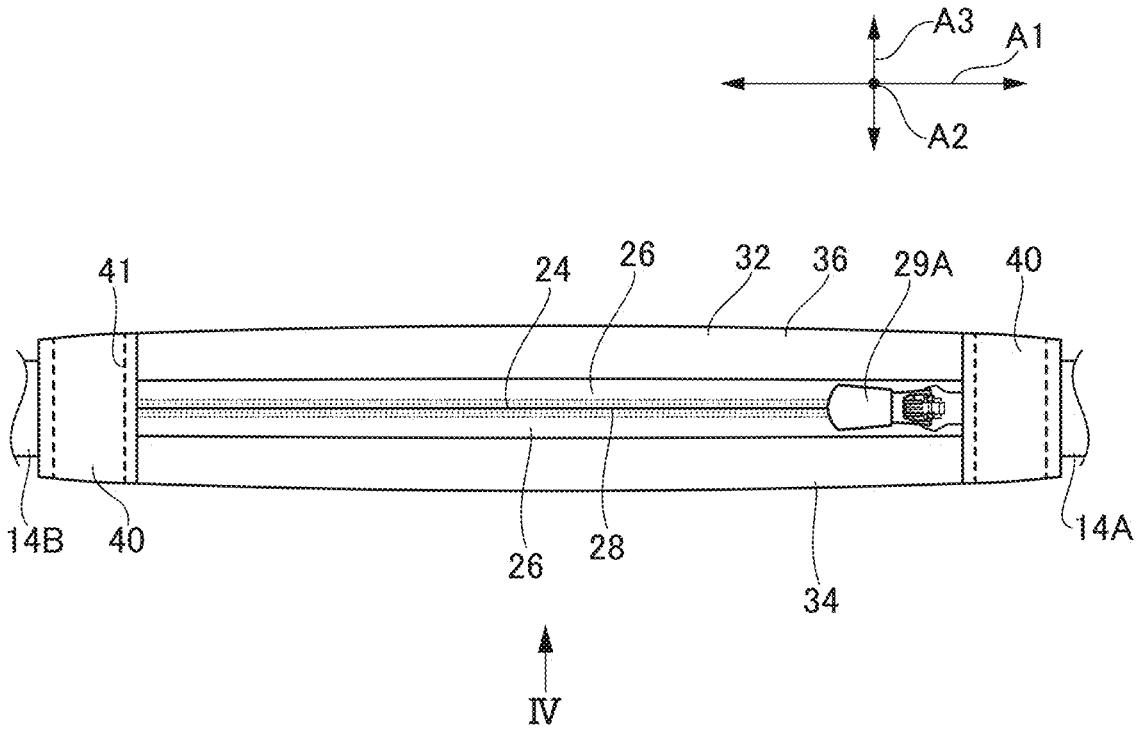
FIG. 3C is a plan view of the bag part of the belt illustrated in FIG. 1, illustrating a state where the fastener is closed and a puller of a slider is folded inward.
Figure 4:
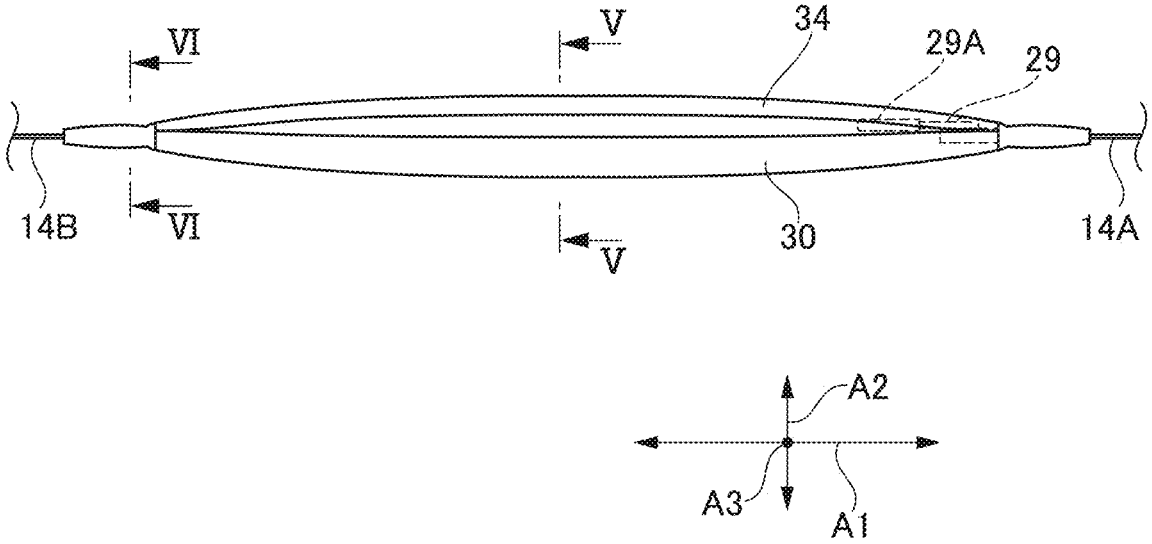
FIG. 4 is an IV arrow view of the bag part in FIG. 3C and is a front view of the bag part of the belt illustrated in FIG. 1.
Figure 5:
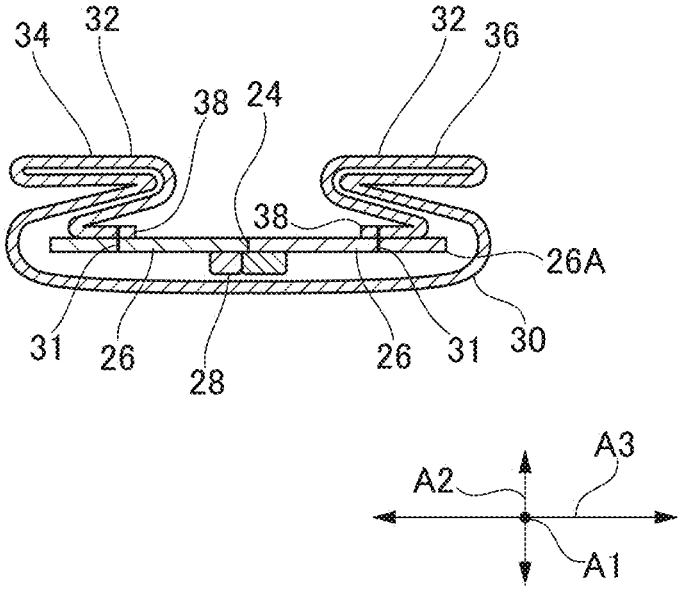
FIG. 5 is a cross-sectional view taken along the V-V line of FIG. 4, and is a view in which illustration of the visible portions on the far side is omitted.
Figure 6:
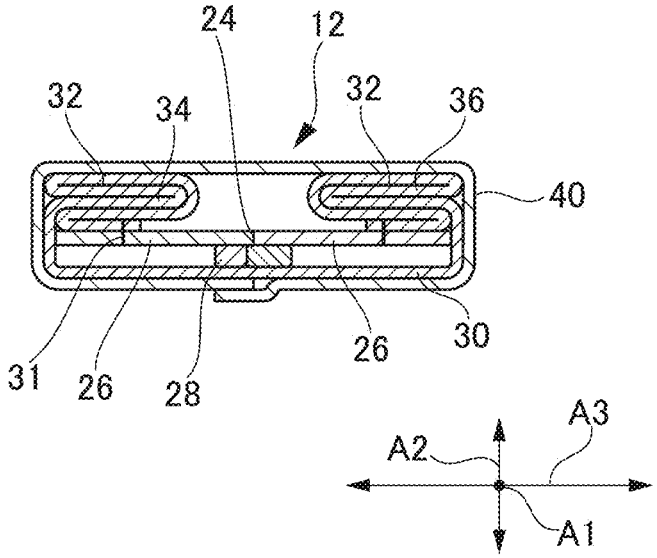
FIG. 6 is a cross-sectional view taken along the VI-VI line of FIG. 4, and is a view in which illustration of the visible portions on the far side is omitted.
Figure 7:
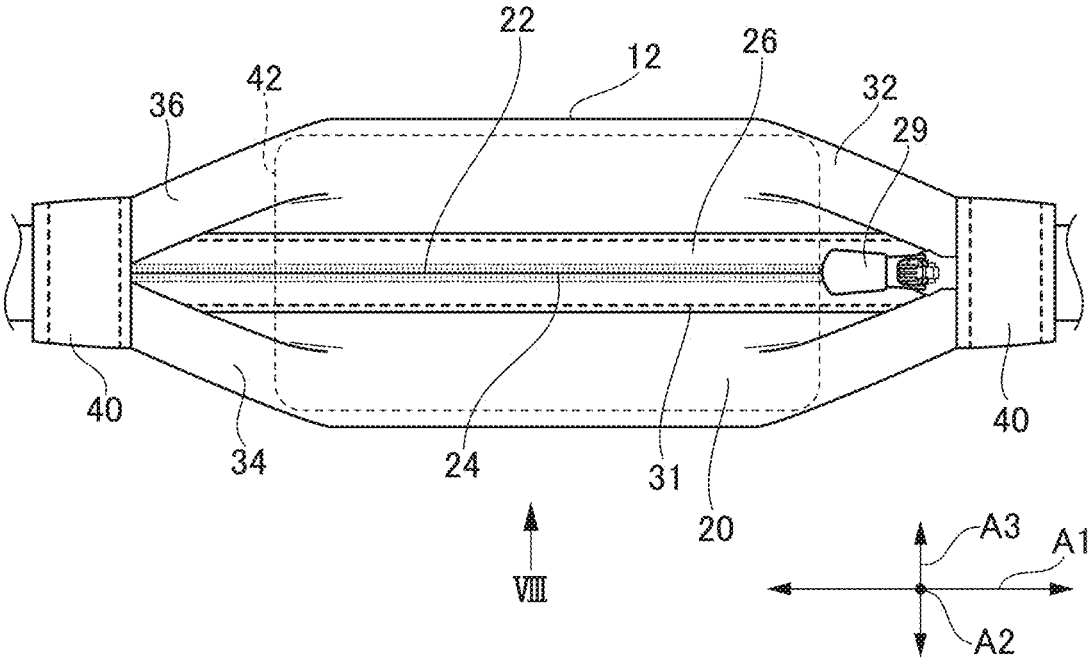
FIG. 7 is a plan view of the bag part of the belt illustrated in FIG. 1 with an article put in the bag part.
Figure 8:
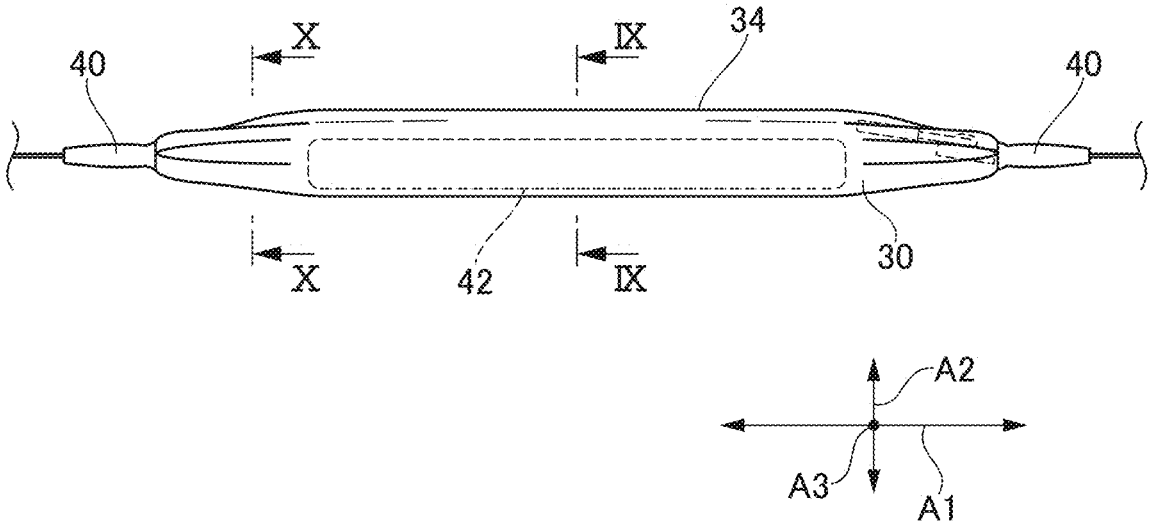
FIG. 8 is an VIII arrow view of the bag part in FIG. 7 and is a front view of the bag part illustrated in FIG. 7.
Figure 9:
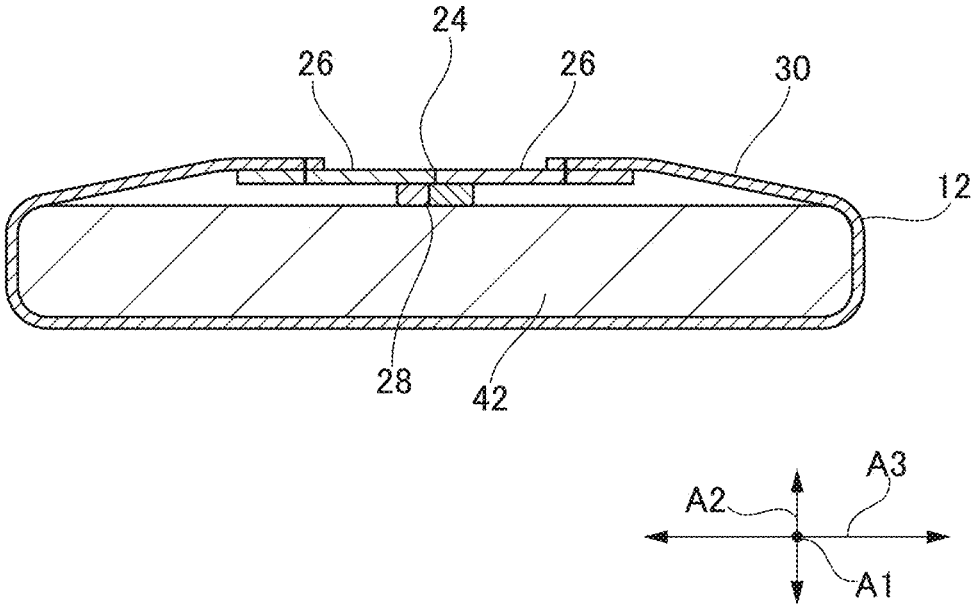
FIG. 9 is a cross-sectional view taken along the IX-IX line of FIG. 8, and is a view in which illustration of the visible portions on the far side is omitted.
Figure 10:
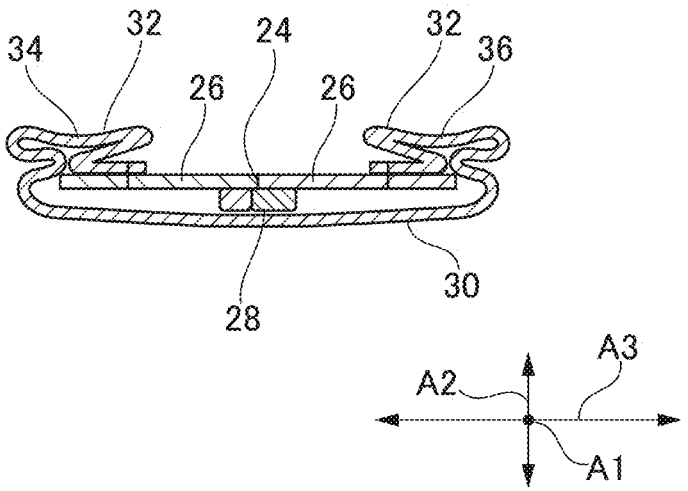
FIG. 10 is a cross-sectional view taken along the X-X line of FIG. 8, and is a view in which illustration of the visible portions on the far side is omitted.

Embodiments of the technology of the present disclosure will be described below based on the drawings. First, a belt 10 according to a first embodiment will be described based on FIGS. 1 to 10. FIGS. 1 and 2 are perspective views of the belt 10 according to the first embodiment. FIGS. 3A to 3C are each a plan view of a bag 12 being a part of the belt illustrated in FIG. 1. FIG. 3A illustrates a state where a fastener is open. FIG. 3B illustrates a state where the fastener is closed. FIG. 3C illustrates a state where a puller 29A of a slider 29 is folded inward. FIG. 4 is an IV arrow view of the bag part in FIG. 3C and is a front view of the bag part of the belt illustrated in FIG. 1. FIGS. 5 and 6 are cross-sectional views taken along the V-V line and the VI-VI line of FIG. 4, respectively, and are views in which illustration of the visible portions on the far side is omitted. FIG. 7 is a plan view of the bag part of the belt illustrated in FIG. 1 with an article 42 put in the bag part. FIG. 8 is a front view of the part being the bag 12 illustrated in FIG. 7. FIGS. 9 and 10 are cross-sectional views taken along the IX-IX line and the X-X line of FIG. 8, respectively, and are views in which illustration of the visible portions on the far side is omitted.

As illustrated in FIG. 1, the belt 10 includes the bag 12 and a belt body 14. The belt body 14 extends from the opposite ends of the bag 12 in a longitudinal direction A1. The belt 10 extends linearly in the form of a band when a buckle 16 being a connection member of the belt body 14 is disengaged, and extends annularly when the buckle 16 is engaged. The belt 10 can be used in various fashions. For example, the belt 10 can be used by wearing it diagonally over one of the left and right shoulders of a human and the flank on the opposite side, by wearing it over only one of the left and right shoulders, or by wearing it around the waist of the human. Incidentally, the belt body 14 may be provided with an adjuster 17 for adjusting the length. Here, the adjuster 17 is provided to each of belt pieces 14A and 14B forming the belt body 14, which extend from the bag 12, but may be provided to only one of them. Alternatively, the adjuster 17 does not have to be present when the belt body 14 is made of an elastic material.

As illustrated in FIG. 3A, the bag 12 of the belt 10 includes an accommodation portion 20 defining and forming an accommodation space 18 therein, and a fastener 24 being an engagement member provided at an access opening 22 of the accommodation portion 20 extending in the longitudinal direction A1. The fastener 24 as an example of the engagement member has an element (interlocking teeth) 28 attached to tape 26, and the slider 29 serving to bring the element 28 into a meshing state. The slider 29 has the puller 29A, which can be folded in the longitudinal direction A1. Here, the element 28 is made of metal but may be made of another material, such as resin. The tape 26 is made of a material that is flexible but has low stretchability. Thus, the fastener 24 extends in the longitudinal direction A1 of the bag 12 and has low stretchability in that longitudinal direction A1. Here, the fastener 24 does not substantially get stretched.

The accommodation portion 20 is formed of a fabric 30 that is flexible and stretchable. Here, for example, the entirety of the fabric 30 of the accommodation portion 20 is made of a fabric containing a rubber material. While not the entirety of the fabric 30 is limited to a rubber-made fabric, it is preferable that at least part of it, in particular, a later-described folded portion 32 (34, 36), is made of a fabric of a stretchable material, such as a rubber-made fabric. The accommodation portion 20 is therefore elastically deformable and has excellent stretchability.

As illustrated in FIG. 7, the accommodation portion 20 is sewed to the tape 26 of the fastener 24. Reference sign "31" denotes a sewing thread. In this way, the access opening 22 of the accommodation portion 20 can be closed by the fastener 24 in an openable and closable fashion.

In the state of FIGS. 1 to 6, i.e., when no article is put in the accommodation portion 20, the bag 12 has a long and narrow shape extending flat in the longitudinal direction A1.

The bag 12 will now be described with reference to FIGS. 5 and 6 in particular. FIG. 5 is a cross-sectional view taken along the V-V line of FIG. 4 crossing substantially the center of the bag 12 in the longitudinal direction A1. FIG. 6 is a cross-sectional view taken along the VI-VI line of FIG. 4 crossing an end portion of the bag 12 in the longitudinal direction A1, in particular a portion fixed with a fixing tape member 40. Note that, in the following description, the side of the bag 12 illustrated in FIG. 1 where the fastener 24 is located, i.e., the engagement member side, will be referred to as "front side", the side that is hidden on the back of the sheet of FIG. 1 and is opposite from the front side will be referred to as "rear side", the direction from the front side toward the rear side will be referred to as "thickness direction A2", and the direction perpendicular to the thickness direction A2 and also perpendicular to the longitudinal direction A1 will be referred to as "width direction A3".

As illustrated in FIGS. 4, 5, and 6, the bag 12, for example, has the folded portion 32, at which the fabric 30 of the bag 12 is folded, on the front side of the bag 12. Here, the folded portion 32 (also termed, lateral folded portion 32) includes two folded portions 34 and 36. These two folded portions 34 and 36 are provided respectively on the lateral sides of the fastener 24 so as to extend in the longitudinal direction A1. Note that the number of folded portions 32 on the front side of the bag 12 is not limited to two, and the bag 12 may have only one folded portion 32.

As illustrated in FIG. 5, the fabric 30 of the bag 12 is fixed to the tape 26 extending in the longitudinal direction A1 on the left and right sides of the fastener 24, and the rear side of the fabric 30 behind the fastener 24, i.e., the rear side of the bag 12, extends so as to define a smoothly curved surface. The folded portions 34 and 36 are positioned near connected portions 38 of the fabric 30 connected to the fastener 24 so as to be present on the front side of the fastener 24 of the bag 12 of the belt 10.

As illustrated in FIG. 6, for this positioning, the fabric 30 of the bag 12 and the fastener 24 are fixed in a compressed state in the thickness direction at the opposite ends of the bag 12 in the longitudinal direction A1 by the fixing tape members 40, which are end fixing members, such that the folded portion 32 (34, 36) is positioned on the front side of the fastener 24 and the fabric 30 extending from one side of the tape 26 of the fastener 24 to the other side of the tape 26 extends in the form of a single piece of the fabric 30 behind the fastener 24, that is, extends without forming an overlap of the fabric. Note that the fixing tape members 40 are directly sewed to the fastener 24 and the fabric 30 to fix the fastener 24 and the fabric 30 to the inner sides of the fixing tape members 40. Reference sign "41" in FIGS. 3A to 3C denotes a sewing thread. The end fixing members are not limited to the sewed fixing tape members 40.

A method of folding the folded portion 32 is folded will now be described with reference to FIG. 5. Note that the folded portions 34 and 36, which are located on the left and right of the fastener 24 in FIG. 5, are substantially horizontally symmetrical. Thus, in the following, the folded portion 36 on the right will be described, and description of the folded portion 34 will be omitted. Also, in the following description, for the folded portions 34 and 36, which are located on the left and right of the fastener 24, the fastener 24 side in the width direction A3 will be referred to as "inner side" and the side away from the fastener 24 will be referred to as "outer side".

At the folded portion 36 in FIG. 5, the connected portions 38 of the fabric 30 connected to the fastener 24 is disposed so as to extend from the inner side toward the outer side in the width direction A3. After extending toward the outer side from the connected portion 38 on the inner side, the fabric 30 extends so as to curve within the width of the tape 26 of the fastener 24 toward the upper side in the thickness direction A2, i.e., the front side, then extend toward the inner side, curve toward the upper side, i.e., the front side, at a position before the element 28 of the fastener 24, extend toward the outer side again, curve toward the lower side in the thickness direction A2, i.e., the rear side, at an edge 26A of the tape 26 of the fastener 24 or at a position slightly outward of the edge 26A, extend toward the inner side to enter the folded portion of the folded fabric 30, curve toward the lower side, i.e., the rear side, at a position inward of the edge 26A of the tape 26 of the fastener 24, extend toward the outer side again, and curve toward the lower side of the fastener 24, i.e., the rear side, at a position outward of the edge 26A of the tape 26 of the fastener 24. In FIG. 6 too, the fabric 30 is provided in this state on the fastener 24.

By providing the folded portion 32 (34, 36) in this manner, an elastic force that holds the bag 12 itself toward the fastener 24 can be applied to the fabric 30.

In particular, this elastic force can be applied when an article is accommodated in the accommodation portion 20 of the bag 12. This elastic force keeps the article from moving in the width direction A3 as the wearer's body or the like moves back and forth. Also, when the belt 10 is worn around the torso, for example, this elastic force helps the fastener 24 to be present around the center of the article in the width direction A3. This enables the fastener 24 to effectively press the article around the center of the article toward the torso and therefore better keeps the article from moving around as the wearer's body moves back and forth.

FIGS. 7 to 10 illustrate the bag 12 with the article 42 put in the accommodation portion 20.

FIGS. 7 and 8 are views of the exterior of the bag 12.

FIG. 9 is a cross-sectional view taken along the IX-IX line of FIG. 8 crossing substantially the center of the bag 12 in the longitudinal direction A1.

FIG. 10 is a cross-sectional view taken along the X-X line of FIG. 8 crossing a position between the IX-IX line of FIG. 8 and one of the fixing tape members 40 in the longitudinal direction A1 of the bag 12 and near the fixing tape member 40.

As illustrated in FIGS. 7 and 8, when the article 42 is put in the accommodation portion 20, the folded portions 34 and 36 are spread as illustrated in FIGS. 9 and 10. In addition to or instead of this, the fabric 30 is extended or stretched, thereby expanding the accommodation space 18. At this time, since the fastener 24 and the fabric 30 are fixed to each other with the folded portions 34 and 36 on the front side of the bag 12 by the fixing tape members 40 and the like (see FIG. 6, for example) at the opposite ends of the bag 12 in the longitudinal direction A1, the fabric 30 receives an elastic force that holds the bag 12 itself toward the fastener 24 on the front side of the bag 12. Those skilled in the art should be better able to understand this from the folds and the like on the fabric 30 around the folded portions 34 and 36 in FIG. 7.

When the belt 10 made in an annular shape as illustrated in FIG. 2 with an article put therein as illustrated in FIGS. 7 and 8 is worn around a human's body, an elastic force that holds the fabric 30 of the bag 12 toward the fastener 24 is exerted on the fabric 30. This keeps the bag 12 from expanding in a direction away from the fastener 24. In addition, the elastic force helps the fastener 24 to be present around the center of the article in the width direction A3. Accordingly, the fastener 24 effectively presses the article around the center of the article in the width direction A3 toward the wear's body in the thickness direction. This allows for tighter contact between the article 42 and the fastener 24 inside the bag 12. As a result, the sense of unity, such as the fit or the wearability, of the belt 10 with a person's body when the belt 10 is used is enhanced. Moreover, movement of the article 42 back and forth inside the bag 12 relative to the fastener 24 due to movement of the wearer's body is more effectively reduced.

Characteristic configurations of the above belt 10 and their operation and advantageous effects will be described further below.

The belt 10 includes the bag 12 formed mostly of the stretchable fabric 30, and the belt body 14 extending from the bag 12. On the side of the bag 12 with the fastener 24, which is an engagement member that opens and closes the access opening 22, the bag 12 has the folded portion 32 (34, 36), at which the fabric 30 of the bag 12 is folded, on the outer side of the fastener 24. In this configuration, on the side of the bag 12 with the fastener 24, which opens and closes the access opening 22, the bag 12 has the folded portion 32 (34, 36), at which the stretchable fabric 30 of the bag 12 is folded, on the outer side of the fastener 24. In this way, when the article 42 is put in the bag 12, the folded portion 32 (34, 36), for example, can partly spread to expand the accommodation space 18 but also apply an elastic force that holds the bag 12 itself toward the fastener 24 at the access opening 22 of the bag 12 to the fabric 30. As described above, the technology of the present disclosure is directed to enabling the belt 10 including the bag 12 and the belt body 14 to hold an article put in the bag 12 more stably inside the bag.

Moreover, the folded portion 32 (34, 36) extends substantially parallel to the fastener 24, which is an engagement member, in the longitudinal direction A1 of the bag 12 and is provided on either lateral side of the fastener 24. In this configuration, the folded portions 34 and 36 are provided on the opposite lateral sides of the fastener 24. Thus, when the article 42 is put in the bag 12, an elastic force that holds the bag 12 itself toward the fastener 24 at the access opening 22 of the bag 12 can be applied more reliably to the fabric 30.

As illustrated in FIG. 6, the fabric 30 of the bag 12 has the folded portion 32 (34, 36) at the ends of the bag 12 in the longitudinal direction A1, and is fixed to the fastener 24 in a compressed state in the thickness direction A2 by the fixing tape members 40 and the sewing threads 41. With this configuration, the folded portion 32 (34, 36) of the fabric 30 makes it possible to more reliably maintain the shape. Thus, when the article 42 is put in the bag 12, an elastic force that holds the bag 12 itself toward the fastener 24 at the access opening 22 of the bag 12 can be applied in a more preferable manner to the fabric 30. Note that the fixing of the fixing tape members 40 to the bag 12 is not limited to fixing with the sewing threads 41.

Further, on the rear side of the bag 12 behind the fastener 24, the fabric 30 extends smoothly from one side toward the other side in the width direction A3. That is, the fabric 30 does not have the folded portion 32, at which the fabric 30 is folded, on the rear side of the bag 12 behind the fastener 24, which is an engagement member.

With this configuration, when an article is put in the bag 12, the bag 12 is less likely to expand unnecessarily in a direction away from the fastener 24 of the bag 12. This effectively keeps the article from moving in the width direction A3.

As illustrated in FIGS. 3A to 3C, the folded portion 32 (34, 36) extends substantially parallel to the fastener 24, which is an engagement member, in the longitudinal direction A1 of the bag 12 and is provided on either lateral side of the fastener 24. With this configuration, when the fastener 24 on the bag 12 of the belt 10 is brought into a closed state (see FIGS. 3B and 3C) from an open state (see FIG. 3A) and the puller 29A on the slider 29 of the fastener 24 is folded inward as illustrated in FIGS. 3C and 4, the amount of protrusion of the puller 29A toward the outer side from the bag 12 is small and is substantially none. This reduces situations where the wearer feels interference with the slider 29 and the puller 29A, and therefore enhances the wear experience of the belt 10.

A belt 110 according to a second embodiment of the technology of the present disclosure will now be described based on FIG. 11. Note that, in the following, only the difference from the belt 10 according to the first embodiment will be described, and description of constituent components equivalent to the constituent components described above will be omitted by, for example, similarly denoting them with the reference signs used above.

The belt 110 according to the second embodiment differs from the belt 10 according to the first embodiment in the method of folding folded portions 34A and 36A of a bag 12A, and shares the same configurations for the other features. Note that, besides the method of folding the folded portions 34A and 36A, they have configurations similar to those of the folded portions 34 and 36 in the first embodiment. Hence, description is omitted below except for the method of folding the folded portions 34A and 36A and features related to it.

Figure 11:
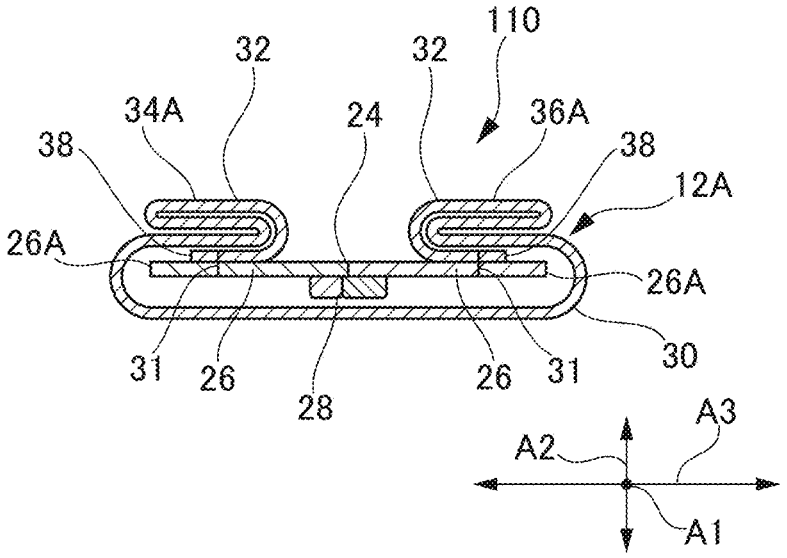
FIG. 11 is a cross-sectional view of a bag part of a belt according to a second embodiment which corresponds to FIG. 5 and is taken along a line corresponding to the V-V line of FIG. 4, and is a view in which illustration of the visible portions on the far side is omitted.

FIG. 11 is a view corresponding to FIG. 5 of the belt 10 according to the first embodiment. At the folded portion 36A in FIG. 11, the connected portions 38 of the fabric 30 connected to the fastener 24 is disposed so as to extend from the outer side toward the inner side in the width direction A3. After extending toward the inner side from the connected portion 38 on the outer side, the fabric 30 extends so as to curve toward the upper side, i.e., the front side, at a position before the element 28 of the fastener 24, then extend toward the outer side, curve toward the lower side in the thickness direction A2, i.e., the rear side, at the edge 26A of the tape 26 of the fastener 24 or at a position slightly outward of the edge 26A, extend toward the inner side to enter the folded portion of the folded fabric 30, curve toward the lower side, i.e., the rear side, at a position inward of the edge 26A of the tape 26 of the fastener 24, extend toward the outer side again, and curve toward the lower side of the fastener 24, i.e., the rear side, at a position outward of the edge 26A of the tape 26 of the fastener 24. Note that the folded portion 34A on the left in FIG. 11 is provided similarly. Though not illustrated, the fabric 30 is provided in this state with respect to the fastener 24 also at a position corresponding to the position in the belt 10 according to the first embodiment in FIG. 6.

By providing the folded portion 32 (34A, 36A) as described above on the front side of the bag 12 of the belt 110, the belt 110 also brings about operation and advantageous effects similar to those described in the first embodiment.

A belt 210 according to a third embodiment of the technology of the present disclosure will now be described based on FIG. 12. Note that, in the following, only the difference from the belt 10 according to the first embodiment will be described, and description of constituent components equivalent to the constituent components described above will be omitted by, for example, similarly denoting them with the reference signs used above.

The belt 210 according to the third embodiment differs from the belt 10 according to the first embodiment in the method of folding folded portions 34B and 36B of a bag 12B, and shares the same configurations for the other features. Note that, besides the method of folding the folded portions 34B and 36B, they have configurations similar to those of the folded portions 34 and 36 in the first embodiment. Hence, description is omitted below except for the method of folding the folded portions 34B and 36B and features related to it.

Figure 12:
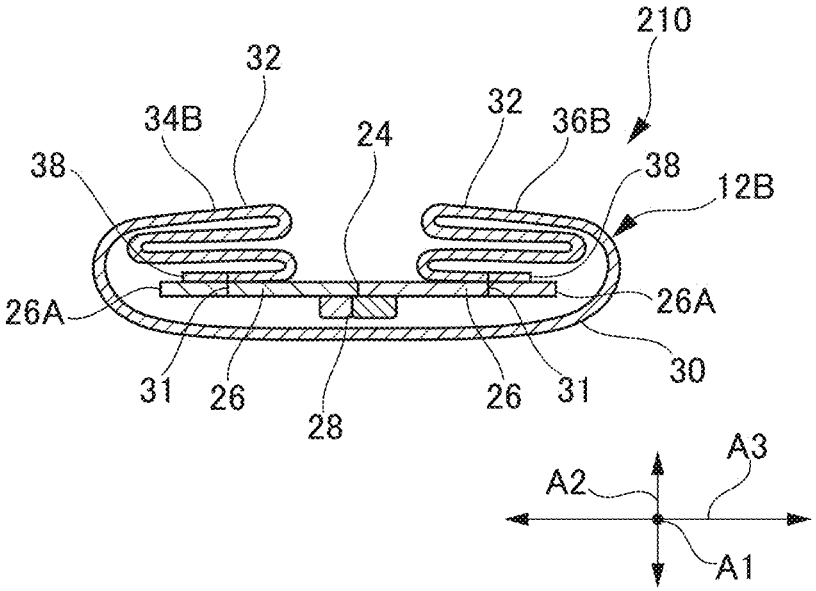
FIG. 12 is a cross-sectional view of a bag part of a belt according to a third embodiment which corresponds to FIG. 5 and is taken along a line corresponding to the V-V line of FIG. 4, and is a view in which illustration of the visible portions on the far side is omitted.

FIG. 12 is a view corresponding to FIG. 5 of the belt 10 according to the first embodiment. At the folded portion 36B in FIG. 12, the connected portions 38 of the fabric 30 connected to the fastener 24 is disposed so as to extend from the outer side toward the inner side in the width direction A3. After extending toward the inner side from the connected portion 38 on the outer side, the fabric 30 extends so as to curve toward the upper side, i.e., the front side, at a position before the element 28 of the fastener 24, then curve toward the outer side, curve toward the upper side in the thickness direction A2, i.e., the front side, at the edge 26A of the tape 26 of the fastener 24 or at a position slightly outward of the edge 26A, extend toward the inner side to further overlap the outer side of the folded portion of the fabric 30, curve toward the upper side, i.e., the front side, at a position before the element 28 of the fastener 24, curve toward the outer side again, curve toward the lower side in the thickness direction A2, i.e., the rear side, at a position outward at the edge 26A of the tape 26 of the fastener 24, and curve toward the lower side of the fastener 24, i.e., the rear side. Note that the folded portion 34B on the left in FIG. 12 is provided similarly. Though not illustrated, the fabric 30 is provided in this state with respect to the fastener 24 also at a position corresponding to the position in the belt 10 according to the first embodiment in FIG. 6.

By providing the folded portion 32 (34B, 36B) as described above on the front side of the bag 12 of the belt 210, the belt 210 also brings about operation and advantageous effects similar to those described in the first embodiment.

Representative embodiments of the technology of the present disclosure and the like have been described above, but the technology of the present disclosure is not limited to those, and various changes can be made thereto. Various replacements and changes can be made without departing from the spirit and scope of the technology of the present disclosure defined by the claims of the present application.

For example, the method of folding the folded portion 32 is not limited to those in the first to third embodiments, and accepts other folding methods. The folded portion 32 can employ various folding methods in which the fabric 30 has portions that directly overlap each other in the thickness direction A2. Accordingly, the foregoing detailed description is intended to be illustrative rather than restrictive.

The invention claimed is:

1. A belt comprising:

a bag; and a belt body, wherein the bag is at least partly formed of a stretchable fabric, the belt body extends from opposite ends of the bag in a longitudinal direction of the bag such that the belt extends in a band shape when a fastening member including a buckle is disengaged and extends annularly when the fastening member including the buckle is engaged, on a front side of the bag with a fastener that opens and closes an access opening of the bag, the bag has a lateral folded portion at which the fabric of the bag is folded on a laterally outer side of the fastener, wherein the lateral folded portion is structurally configured such that, in an at-rest condition, the fabric follows a folding sequence comprising:

(i) the fabric extending in a lateral direction from a laterally outer end laterally inwardly toward the fastener along a tape of the fastener, (ii) the fabric curving in a thickness direction transverse to the longitudinal and lateral directions away from the front side of the bag at a lateral position before an element of the fastener, (iii) the fabric extending in the lateral direction laterally outwardly away from the fastener to form and define the lateral folded portion, (iv) the fabric curving in the thickness direction toward the front side of the bag at an edge of the tape or at a lateral position immediately adjacent to the edge, and (v) the fabric extending in the lateral direction laterally inwardly toward the fastener within the lateral folded portion;

and the lateral folded portion extends substantially parallel to the fastener in the longitudinal direction of the bag.

2. The belt according to claim 1, wherein the lateral folded portion is provided on opposite lateral sides of the fastener.

3. The belt according to claim 1, wherein at the ends of the bag in the longitudinal direction, the fabric of the bag has the lateral folded portion and is fixed to the fastener in a compressed state in the thickness direction.

4. The belt according to claim 1, wherein on a rear side of the bag behind the fastener, the fabric extends smoothly from one side toward another side in the lateral direction.

* * * * *